US005525574A

United States Patent [19]

Edwards

[11] Patent Number: 5,525,574

[45] Date of Patent: Jun. 11, 1996

[54] THERMAL TRANSFER PRINTING RECEIVER SHEET

[75] Inventor: Paul A. Edwards, Harwich, England

[73] Assignee: Imperial Chemical Industires PLC, United Kingdom

[21] Appl. No.: 367,208

[22] PCT Filed: Jul. 9, 1993

[86] PCT No.: PCT/GB93/01437

§ 371 Date: Jan. 17, 1995

§ 102(c) Date: Jan. 17, 1995

[87] PCT Pub. No.: WO94/02324

PCT Pub. Date: Feb. 3, 1994

[30] Foreign Application Priority Data

Jul. 16, 1992 [GB] United Kingdom ..... 9215167

[51] Int. Cl.[6] ..... B41M 5/035; B41M 5/38

[52] U.S. Cl. ..... 503/227; 428/195; 428/480; 428/532; 428/913; 428/914

[58] Field of Search ..... 428/195, 480, 428/488.4, 532, 913, 914, 323; 503/227

[56] References Cited

FOREIGN PATENT DOCUMENTS

| | | | |
|---|---|---|---|
| 0272400 | 6/1988 | European Pat. Off. | 503/227 |
| 61-3796 | 1/1986 | Japan | 503/227 |
| 62-16185 | 1/1987 | Japan | 503/226 |
| 62-11680 | 1/1987 | Japan | 503/226 |

OTHER PUBLICATIONS

Japan Patent Abstract, vol. 10, No. 151 (M-483) (2208) 31 May 1986 & JP, A,61,003 796 (Mitsubishi Seishi KK).

Japan Patent Abstract, vol. 11, No. 183 (M-598(2630) 12 Jun. 1987 & JP A 61 011 680 (Tomoegawa Paper).

Japan Patent Abstract, vol. 11, No. 191 (M-600) (2638) 19 Jun. 1987 & JP A 62 016 185 (Tomoegawa Paper).

*Primary Examiner*—Bruce Hess
*Attorney, Agent, or Firm*—John M. Sheehan

[57] ABSTRACT

A thermal transfer printing receiver sheet which comprises a substrate having a dye-receiving surface on one side and a backcoat on the other side wherein the backcoat comprises a sulphonated polyester.

10 Claims, No Drawings

THERMAL TRANSFER PRINTING RECEIVER SHEET

This invention relates to a thermal transfer printing (TTP) receiver sheet and especially to a TTP receiver sheet having a backcoat which possesses improved properties.

Thermal transfer printing is a printing process in which a dye is caused, by thermal stimuli, to transfer from a dye sheet to a receiver sheet. In such processes, the dye sheet and receiver sheet are placed in intimate contact, the thermal stimuli are applied to the dye sheet and the dye sheet and receiver sheet are then separated. By applying the thermal stimuli to pre-determined areas in the dye-sheet, the dye is selectively transferred to the receiver to form the desired image.

Receiver sheets conventionally comprise a substrate with a dye-receiving polar surface on one side, into which a dye is thermally transferable and retainable. Where the substrate is itself polar and capable of receiving a dye, the dye may be transferred directly to a surface of the substrate. However receiver sheets typically comprise a substrate supporting a receiver layer specifically tailored to receive the dye.

Receiver sheets may also comprise a backcoat on the opposite surface to the dye-receiving surface which is typically employed to impart desirable characteristics to the sheet to improve both processing of the sheet during application of the TTP image and the end use properties of the sheet depending on the particular application of the sheet.

In many applications, for example for use as post cards and greetings cards, it is a requirement that the backcoat be capable of receiving drafting marks from for example pencils and inks, both aqueous and solvent based. Other characteristics which the backcoat should desirably possess when employed in such applications include a good resistance to smudging of the applied drafting marks and an ability to accept aqueous based adhesives, for example to allow adherence of a postage stamp to the sheet.

Hitherto, receiver sheets for use in such applications have been deficient in certain respects due to the combination of properties which it is desired that such a receiver sheet should possess.

However, we have now devised a receiver sheet which has a backcoat having an improved combination of characteristics which make the sheet particularly suitable for use in applications in which drafting marks are to be applied to the backcoat and/or adhesive, especially aqueous based adhesive is to be accepted by the backcoat.

According to a first aspect of the invention there is provided a thermal transfer printing receiver sheet which comprises a substrate having a dye-receiving surface on one side and a backcoat on the other side wherein the backcoat comprises a sulphonated polyester.

The backcoat of receiver sheets according to the first aspect of the invention are compatible with both aqueous based and non aqueous based materials and thus provide good adhesion to both non aqueous and aqueous based adhesives which may be employed to adhere labels, stamps and the like to the receiver backcoat. Furthermore, this compatibility improves the capability to receive non-aqueous and aqueous based inks and provides an improved writability for the receiver backcoat.

Suitably, the sulphonated polyester in the backcoat is a salt of a sulphonated polyester, for example an alkali metal salt and preferably an ammonium salt. Particularly preferred sulphonated polyesters include Eastman Size WD30, AQ29, AQ38 and AQ55 (solid or dispersion) available from Eastman Kodak and Toyobo MD1400 sulphonated polyesters.

The sulphonated polyester is suitably present in the backcoat in an amount of at least 30% by weight of the back coat to maintain the mechanical integrity of the coating and to avoid an undesirable decrease in the adhesion of the backcoat to the substrate. Preferably the sulphonated polyester is present in an amount of up to 80% by weight of the backcoat and especially 40 to 70% by weight.

Suitably, the sulphonated polyester has an average molecular weight of up to about 30000 and preferably in the range 10000 to 20000. The sulphonated polyester may be of any viscosity which allows application to the substrate but desirably has a melt viscosity at 200° C. of up to about 50000 poise as measured using the Sieglaff/McKelvey capillary rheometer at 100 $sec^{-1}$ shear rate. Desirably the sulphonated polyester has a glass transition temperature (Tg) of up to about 100° C.

The sulphonated polyester is suitably hydrophilic and is desirably soluble or dispersible in water as this provides improved compatibility with aqueous based adhesives.

We have also found that writability may be improved by the incorporation of a cellulosic polymer into the backcoat of a receiver sheet. Accordingly, a second aspect of the invention provides a thermal transfer printing receiver sheet which comprises a substrate having a dye-receiving surface on one side and a backcoat on the other side wherein the backcoat comprises a sulphonated polyester and a cellulosic polymer.

The cellulosic polymer is desirably polar or a salt as this aids water retention thus providing improved writability for aqueous based inks and also improved compatibility for aqueous based adhesives. Suitably the cellulosic polymers include a hydroxyalkylcellulose, for example hydroxypropylcellulose and METHOCEL E50 LV, a hydroxypropylmethylcellulose, and especially a salt of carboxyalkylcellulose, for example COURLOSE F20G, a sodium carboxymethylcellulose available from Courtaulds.

Suitably, the cellulosic polymer is present in the backcoat in sufficient amount to improve the writability of the backcoat, preferably at least 2% and more preferably at least 4% by weight of the backcoat. Desirably the cellulosic polymer is present in an amount not exceeding 15% and preferably not exceeding 10% by weight of the backcoat as too high a level of the cellulosic polymer may give rise to undesirable characteristics including humid blocking.

A receiver according to the invention preferably comprises an electrically conductive material, for example a conductive particulate material or a conductive polymer, in the backcoat to improve the antistatic performance of the receiver.

A further aspect of the invention provides a thermal transfer printing receiver sheet which comprises a substrate having a dye-receiving surface on one side and a backcoat on the other side wherein the backcoat comprises a sulphonated polyester and has a surface resistivity in the range $1\times10^{8}$ to $1\times10^{13}$ Ohms per square.

If the sulphonated polyester does not itself provide a backcoat having the desired surface resistivity, the backcoat may further comprise an electrically conducting material to provide a backcoat having the desired resistivity.

If the backcoat resistivity is too low, problems due to dipolar charge formation may occur wherein there is a small charge on the dye-receiving surface of the receiver and effectively no charge on the backcoat. This charge imbalance may cause receivers to stick together when stacked. Further, if the resistivity is too high, there may be an undesirable build up of static charge on the printer.

Preferably, the backcoat has a surface resistivity of $1\times10^9$ to $1\times10^{12}$Ohms per square. A receiver which has a small charge of the same polarity on both the backcoat and the dye-receiving surface may provide optimum feed and stacking performance.

By employing a conductive particulate material, desirably as a particle having a conductive coating, we have found that excellent antistatic properties may be secured in addition to the improved adhesion and writability.

Accordingly, a further aspect of the invention provides a thermal transfer printing receiver sheet which comprises a substrate having a dye-receiving surface on one side and a backcoat on the other side wherein the backcoat comprises a sulphonated polyester and a conductive particulate material, preferably comprising a particle having an electrically conductive coating.

The improved antistatic properties reduce handling problems and the tendency for adjacent sheets to stick to each other whilst in a stack. Desirably, the conductive material conducts electronically rather than ionically. This provides the advantage that the conductance of the backcoat is independent of the moisture content of the environment and the antistatic performance hence does not vary with humidity. Suitably the conductive particulate material is sufficiently soft to reduce the possibility that the backcoat may score the dye-receiving surface of an adjacent receiver when receivers are arranged in a stack.

The conductive particulate material may comprise particles of a conductive material but preferably comprises a particulate material for example alumina and silica, which is covered with a conductive coating for example a metal oxide doped with a metal. An especially preferred particulate material comprises particles of barium sulphate which are coated with tin oxide doped with antimony which is available from Sachtleben Chemie under the trade name SACON P401.

The conductive material is suitably present in the backcoat in a sufficient quantity to provide improved antistatic performance, preferably at least 15% by weight of the backcoat. Suitably the amount of the conductive material does not exceed 70% by weight as this may render the backcoat unacceptably fragile. Furthermore, as consumers conventionally require white receiver sheet for many applications, the conductive material, if not white in colour, may impart an undesirable colour to the receiver sheet if present in the backcoat in large quantities. Desirably the conductive material is present in the backcoat in an amount of 20 to 50% by weight of the back coat.

Suitably the backcoat has a coat weight in the range 0.5 to 10 $gm^{-2}$ and preferably 1.5 to 4 $gm^{-2}$. The surface resistivity of the backcoat is dependent upon its coat weight and composition and it will be appreciated that, for a given backcoat composition, the coat weight will be selected to provide a surface resistivity within the range $1\times10^8$ to $1\times10$ Ohms per square.

The backcoat may comprise other components as desired for a particular application. The backcoat suitably comprises a filler to reduce image retransfer and blocking. Suitable fillers include micronised polymers which are preferably cross-linkable, for example melamine and urea formaldehyde, available under the trade name PERGOPAK M3, or insoluble in conventional coating solvents for example water, methanol, methyl ethyl ketone and acetone, including for example polyethylene and polytetrafluoroethylene.

The filler, excluding the conductive particulate material if present, is suitably present in an amount of up to 20% by weight and preferably in an amount of 2 to 10% by weight of the backcoat.

Desirably the backcoat also comprises an aqueous dispersing agent to reduce problems of particulate aggregation, suitable agents including surfactants for example SYNPERONIC T/908 available from ICI. The dispersing agent is suitably present in an amount of up to 10% and preferably in an amount of 0.2 to 2% by weight of the backcoat.

Receiver sheets according to the present invention suitably comprise a substrate having a dye-receiving surface on one side.

Substrates which are themselves dye-receiving materials, for example polyvinyl chloride may be adapted by the provision of a smooth surface texture. In most cases, however, receiver sheets comprise a substrate having a receiver layer on one side of the substrate, which layer comprises a dye-receptive composition into which thermally transferable dyes can readily pass in a TTP process.

Receiver sheet substrates known in the art may be employed in the present invention including cellulose fibre paper desirably with a polymer coating, thermoplastic films for example polyethylene terephthalate (desirably biaxially orientated), filled and/or voided thermoplastic films for example pearl film, and laminates of two or more substrate materials.

The receiver layer preferably comprises at least one dye-receptive polymer which is an amorphous polyester, polyvinyl chloride. The polymer may comprise other polymers for example polyvinyl alcohol/polyinyl chloride copolymer as desired.

Commercially available examples of suitable amorphous polyesters include VITEL PE200 Goodyear) and VYLON polyesters (Toyobo) especially grades 103, 200 and 290. Different grades of polyester may be mixed to provide a suitable composition as desired.

If desired, the receiver layer may also comprise a release agent. A preferred release agent is the thermoset reaction product of at least one silicone having a plurality of hydroxyl groups per molecule and at least one organic polyfunctional N-(alkoxymethyl) amine resin which is reactive with the hydroxyl groups under acid catalysed conditions.

If desired the backcoat and/or the receiver layer may be applied be separated from the substrate by a conventional primer layer known in the art which may be employed for example to improve adhesion of the the backcoat and/or receiver layer to the substrate.

The coatings applied to the substrate may be applied by conventional coating techniques for example gravure coating, reverse gravure coating and using a Meyer bar. The coating may be deposited as a solution or a dispersion as desired from any suitable solvent for example water, acetone, methyl ethyl ketone and methanol which is then suitably removed by drying. Suitable drying conditions include, heating in air at a temperature of 60° to 110° C. for a period of 30 seconds to 2 minutes according to the coating solvent employed.

The invention is illustrated by the following non-limiting examples.

EXAMPLE 1

A receiver according to the present invention was produced by coating onto a sample of Melinex D969 polyester film available from ICI with a Meyer bar, a dispersion containing 8% by weight of solids, in a solvent system comprising water:methanol:methyl ethyl ketone in a 50:25:25 volume ratio, of the following composition

| Composition (Parts by Weight) | 1A | 1B | 1C | 1D |
|---|---|---|---|---|
| EASTMAN SIZE WD30 (sulphonated polyester) | 51 | 50 | 68 | 48 |
| SACON P401 (conductive particles) | 43 | 43 | 25 | 45 |
| COURLOSE F20G (sodium carboxymethylcellulose) | 6 | - - | 5 | - - |
| METHOCEL E50 LG (Hydroxypropylmethylcellulose) | - - | 7 | - - | 7 |
| SYNPERONIC T/908 (surfactant) | 0.4 | 0.5 | 0.5 | 0.5 |
| PERGOPAK M3 (filler) | 3 | 6 | 6 | 6 |

The backcoat was dried at between 60° and 110° C. for between 30 seconds to 2 minutes to produce a backcoat having a weight of 1.3, 2.5, 2.0 and 2.5 $gm^{-2}$ for receiver sheets 1A to 1D respectively.

Stamp Adhesion:

A stamp having an aqueous-based adhesive gum was wetted, applied to the backcoat and left for 2 minutes after which time, it was attempted to peel the stamp from the backcoat.

Resistivity:

The receiver sheet was stored for a period of 1 hour at a temperature of 25° C. in a relative humidity of 60%, after which time, the resistivity of the backcoat was measured using a Model TI500 Surface Resistivity meter from Static Control Services.

Static Charge:

The static charge on the backcoat was measured after the receiver sheet had been passed through a Hitachi VY200 printer.

Stacking:

100 receiver sheets procuced in accordance with Example 1 were passed through a Hitachi VY200 printer and the stacking of the sheets was observed.

| Results<br>Test | Examples 1A, 1B, 1C, 1D | Prior Art |
|---|---|---|
| Writability:<br>Pencils | Good line uniformity and density | Good line uniformity and density |
| Writability:<br>Solvent based ink pens | Good line uniformity and density | Good line uniformity and density |
| Writability:<br>Biro pens | Good line uniformity and density | Good line uniformity and density |
| Writability:<br>Aqueous based ink pens | Good line uniformity and density without any ink retraction | Ink retraction occurs |
| Smudge Resistance: | | |
| Aqueous based ink pens | Good resistance | Smudge easily |
| Pencils | Slight smudge | Smudge easily |
| Stamp Adhesion | Stamp damaged when attempting removal | Remove easily without damage to stamp |
| Surface Resistivity | $1 \times 10^{10}$ | $1 \times 10^{14}$ |
| Post Printing Static | 6 kV | 20 + kV |
| Post Printing Stacking | Good | Levitation of sheet in outfeed and printer jamming due to back feed to back feeding |

EXAMPLE 2

A receiver sheets produced according to Examples 1A to 1D were tested (according to the tests below) to assess various characteristics thereof. A commercially available receiver sheen having a writable backcoat comprising a styrene/maleic anhydride copolymer was also tested for comparative purposes.

Writability:

Marks were applied to the :receiver backcoat using a variety of pencils of different hardnesses and variety of pens having different inks including, aqueous based and mixed solvent non-aqueous based inks. The marks were then visually observed for their line density and uniformity.

Smudge Test:

Ink and pencil marks were applied to the backcoat as in the writability test. The marks were left for a set period and then rubbed with a finger to assess the degree to which the marks smudged.

The receiver sheets produced in Example 1 exhibited excellent writeability and compared with the prior art sheet have improved writability with aqueous-based inks, improved smudge properties with all of the pencils and different inks tested, improved adhesion to an aqueous based adhesive and superior snacking properties due to the lower surface resistivity and post printing static.

I claim:

1. A thermal transfer printing receiver sheet which comprises a substrate having a dye-receiving surface on one side and a backcoat on the other side wherein the backcoat comprises a sulphonated polyester.

2. A receiver sheet according to claim 1 in which the sulphonated polyester comprises an ammonium salt of a sulphonated polyester.

3. A receiver sheet according to claim 1 or claim 2 in which the sulphonated polyester is present in the backcoat in an amount in the range 30% to 80% by weight of the back coat.

4. A receiver sheet according to claim 1 in which the sulphonated polyester has an average molecular weight of up to about 30000.

5. A receiver sheet according to claim 1 in which the backcoat has a surface resistivity in the range $1\times10^{8}$ to $1\times10^{13}$ Ohms per square.

6. A receiver sheet according to claim 1 in which the backcoat further comprises a conductive particulate material.

7. A receiver sheet according to claim 6 in which the conductive material is present in the backcoat in an amount of 15% to 70% by weight of the backcoat.

8. A receiver sheet according to claim 1 in which the backcoat further comprises a cellulosic polymer.

9. A receiver sheet according to claim 8 in which the cellulosic polymer comprises a hydroxyalkylcellulose and/or a salt of carboxyalkylcellulose.

10. A receiver sheet according to claim 8 or claim 9 in which the cellulosic polymer is present in the backcoat in an amount not exceeding 15% by weight of the backcoat.

* * * * *